US011751749B2

(12) United States Patent
Rowe et al.

(10) Patent No.: US 11,751,749 B2
(45) Date of Patent: Sep. 12, 2023

(54) DISHWASHER AND SILVERWARE BASKET THEREOF

(71) Applicant: Haier US Appliance Solutions, Inc., Wilmington, DE (US)

(72) Inventors: Jason Allen Rowe, Louisville, KY (US); Andrew Garstkiewicz, Georgetown, IN (US); Jeffrey Charles Souder, Sellersville, PA (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 335 days.

(21) Appl. No.: 16/930,832

(22) Filed: Jul. 16, 2020

(65) Prior Publication Data

US 2022/0015604 A1 Jan. 20, 2022

(51) Int. Cl.
*A47L 15/42* (2006.01)
*A47L 15/50* (2006.01)

(52) U.S. Cl.
CPC ..... *A47L 15/502* (2013.01); *A47L 15/4214* (2013.01); *A47L 15/505* (2013.01)

(58) Field of Classification Search
None
See application file for complete search history.

(56) References Cited

U.S. PATENT DOCUMENTS

2017/0112352 A1* 4/2017 Naik ..... A47L 15/22

FOREIGN PATENT DOCUMENTS

| | | | |
|---|---|---|---|
| DE | 102005008374 | A1 | 8/2006 |
| DE | 102017205726 | B4 | 11/2019 |
| EP | 1256309 | A1 | 11/2002 |
| EP | 2074924 | B1 | 12/2010 |
| GB | 2255711 | A | 11/1992 |

* cited by examiner

*Primary Examiner* — Levon J Shahinian
(74) *Attorney, Agent, or Firm* — Dority & Manning, P.A.

(57) ABSTRACT

A dishwasher or silverware basket, as provided herein, may include a unitary first base wall, first sidewall, second base wall, second sidewall, transverse rail, and handle. The first base wall may be disposed at a bottom container end. The first sidewall may extend vertically from the first base wall and define a first container volume with the first base wall. The second base wall may be disposed at the bottom container end and transversely spaced apart from the first base wall. The second sidewall may extend vertically from the second base wall and define a second container volume with the second base wall. The transverse rail may extend from the first sidewall to the second sidewall The handle may extend between the container volumes and have a first transverse edge proximal to the first container volume and a second transverse edge proximal to the second container volume.

20 Claims, 7 Drawing Sheets

DISHWASHER AND SILVERWARE BASKET THEREOF

FIELD OF THE INVENTION

The present subject matter relates generally to dishwashing appliances, and more particularly to dishwashing appliances and silverware baskets thereof.

BACKGROUND OF THE INVENTION

A dishwasher or dishwashing appliance generally includes a tub that defines a wash chamber for receipt of articles for washing. Certain dishwashing appliances also include a rack assembly slidably mounted within the wash chamber. A user can load articles, such as plates, bowls, glasses, or cups, into the rack assembly, and the rack assembly can support such articles within the wash chamber during operation of the dishwashing appliance.

Certain dishwashing appliances also include a silverware basket configured for receipt of articles (e.g., forks, knives, spoons, or other utensils) for washing. The silverware basket is often formed from multiple molded polymer pieces and can be mounted within the wash chamber in various configurations. For example, the silverware basket can be mounted within the rack assembly, on a front of the rack assembly, or on a door of the appliance. Typically, such silverware baskets can be selectively removed from the rack assembly or other portion of the dishwashing appliance on which such baskets are mounted. As a result, a handle is often attached to the silverware basket so that a user has something to hold when the silverware basket is removed from the dishwashing appliance.

In spite of the utility of existing appliance-basket configurations, several issues exist. For instance, since the handle is separately attached to the rest of the basket, the basket and handle may be more likely to break. Moreover, undesirable costs, difficulties, and inefficiencies may be incurred in order to assemble the basket and handle. Additionally or alternatively, since many silverware basket handles are made from plastics or polymers, it can be difficult to create a handle that does not include parting lines (e.g., created during an injection molding process) at the top or bottom of the handle. Unfortunately, these parting lines can define a narrow edge. If such parting lines are not removed by a post-molding process, a user's fingers may quickly become uncomfortable while holding the handle. Post-molding processes, though, again add expense and difficulties to the overall basket assembly. Further additionally or alternatively, under certain conditions, the handle may incur significant stresses, such as when the basket is full or is at a relatively high temperature (e.g., immediately following a wash cycle). Such stress can deform, break, or in some other manner damage the overall basket.

As a result, it would be useful to provide a dishwashing appliance or silverware basket having structures or features to address one or more of the above issues. In particular, it may be advantageous to provide an appliance or basket that could be comfortably held by a user (e.g., without requiring significant post-molding processing or assembly). Additionally or alternatively, it may be advantageous to provide an appliance or basket configured to resist deformation or damage, even at relatively high temperatures (e.g., without requiring significant post-molding processing or assembly).

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a dishwashing appliance is provided. The dishwashing appliance may include a tub, a pump, a spray assembly, a rack assembly, and a unitary basket. The tub may define a wash chamber. The pump may be configured to deliver a wash fluid into the wash chamber. The spray assembly may be housed within the wash chamber of the tub in fluid communication with the pump to receive wash fluid therefrom. The rack assembly may be slidably disposed within the wash chamber. The unitary basket may be selectively received within the rack assembly. The unitary basket may include a first base wall, a first sidewall, a second base wall, a second sidewall, a first transverse rail, a second transverse rail, and a handle. The first base wall may be disposed at a bottom container end. The first sidewall may extend vertically from the first base wall to a top container end. The first sidewall may define a first container volume with the first base wall. The second base wall may be disposed at the bottom container end. The second base wall may be transversely spaced apart from the first base wall. The second sidewall may extend vertically from the second base wall to the top container end. The second sidewall may define a second container volume with the second base wall. The first transverse rail may extend from the first sidewall to the second sidewall on a first lateral side of the unitary basket. The second transverse rail may extend from the first sidewall to the second sidewall on a second lateral side of the unitary basket. The handle may extend from the first transverse rail to the second transverse rail between the first container volume and the second container volume. The handle may have a first transverse edge proximal to the first container volume and a second transverse edge proximal to the second container volume.

In another exemplary aspect of the present disclosure, a unitary silverware basket for a dishwashing appliance is provided. The silverware basket may include a first base wall, a first sidewall, a second base wall, a second sidewall, a transverse rail, and a handle. The first base wall may be disposed at a bottom container end. The first sidewall may extend vertically from the first base wall to a top container end. The first sidewall may define a first container volume with the first base wall. The second base wall may be disposed at the bottom container end. The second base wall may be transversely spaced apart from the first base wall. The second sidewall may extend vertically from the second base wall to the top container end. The second sidewall may define a second container volume with the second base wall. The transverse rail may extend from the first sidewall to the second sidewall The handle may extend from the transverse rail between the first container volume and the second container volume. The handle may have a first transverse edge proximal to the first container volume and a second transverse edge proximal to the second container volume. A first parting line may be defined along the first transverse edge. A second parting line may be defined along the second transverse edge.

In yet another exemplary aspect of the present disclosure, a silverware basket for a dishwashing appliance is provided. The silverware basket may include a first base wall, a first sidewall, a second base wall, a second sidewall, a transverse rail, and a handle. The first base wall may be disposed at a bottom container end. The first sidewall may extend vertically from the first base wall to a top container end. The first sidewall may define a first container volume with the first base wall. The second base wall may be disposed at the bottom container end. The second base wall may be transversely spaced apart from the first base wall. The second sidewall may extend vertically from the second base wall to the top container end. The second sidewall may define a second container volume with the second base wall. The transverse rail may extend from the first sidewall to the second sidewall The handle may extend from the transverse rail between the first container volume and the second container volume. The handle may have a first transverse edge proximal to the first container volume and a second transverse edge proximal to the second container volume. The handle may define a bottom surface and a top surface. The bottom surface may extend from the first transverse edge to the second transverse edge. The top surface may extend from the first transverse edge to the second transverse edge opposite the bottom surface. The handle may further define a non-orthogonal first transition radius extending between the bottom surface and the first transverse edge. The handle may still further define a non-orthogonal second transition radius extending between the bottom surface and the second transverse edge.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
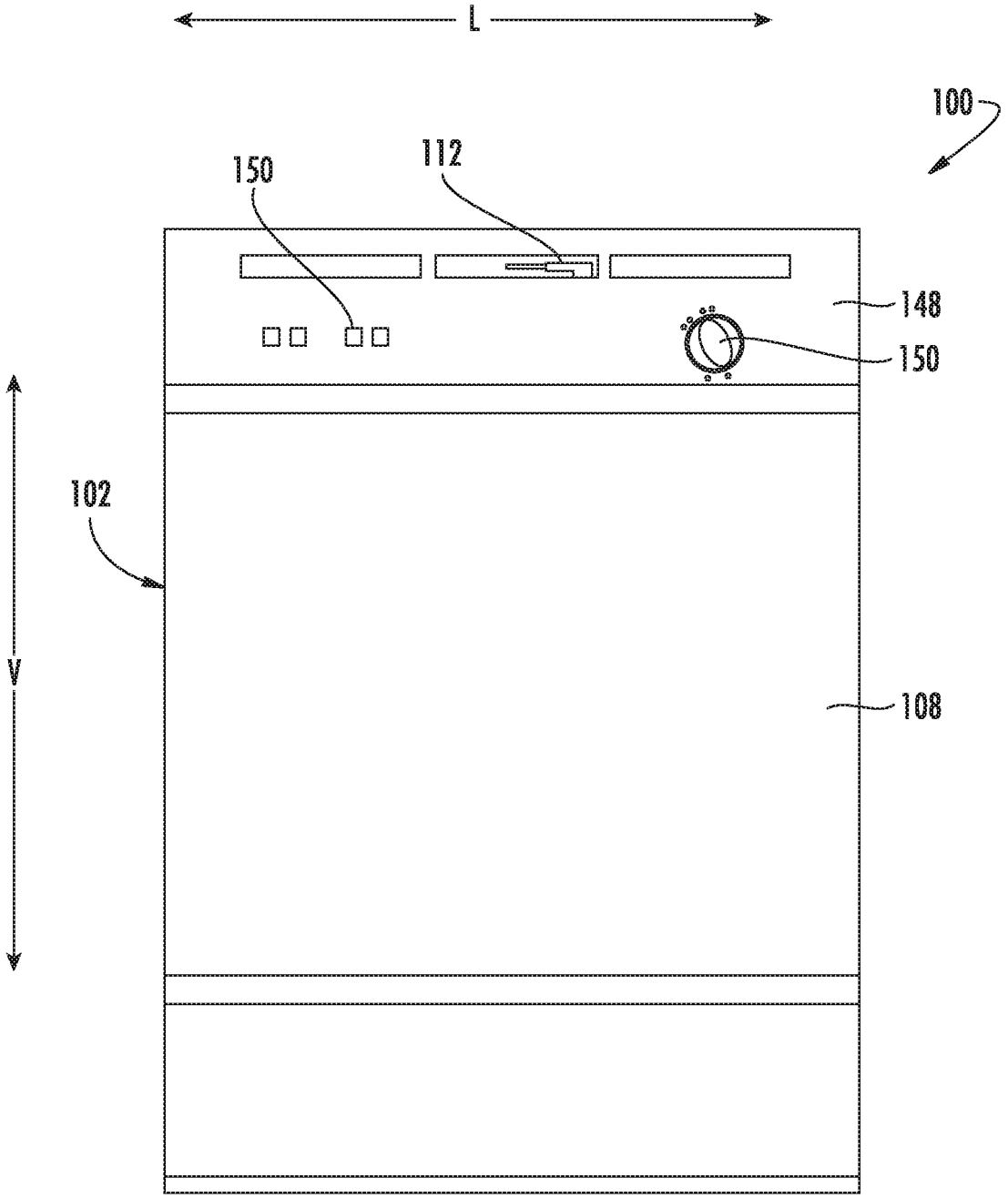
FIG. 1 provides a front elevation view of a dishwashing appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," "third," and "fourth" may be used interchangeably to distinguish one component from another and are not intended to signify location or importance of the individual components.

Figure 2:
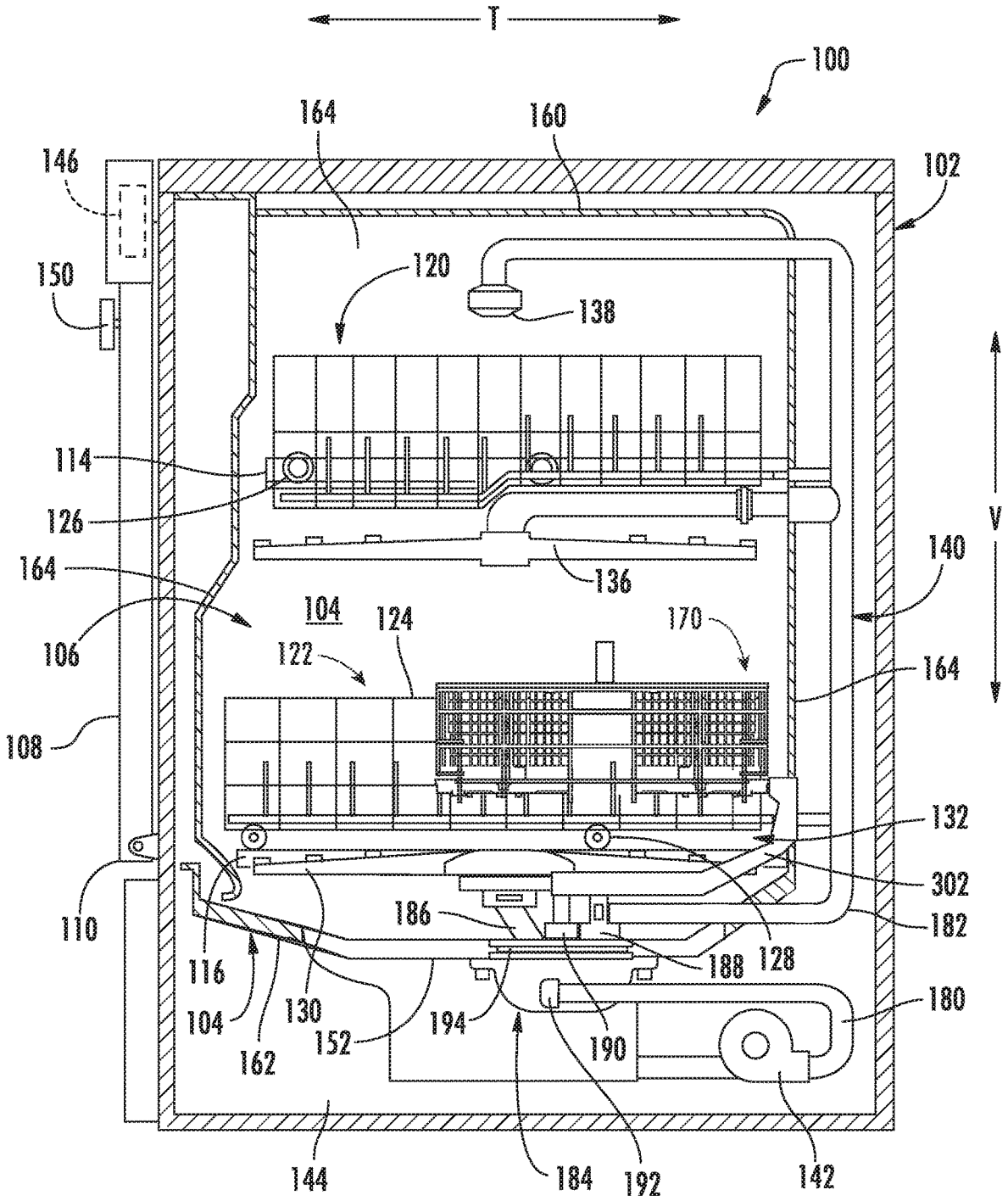
FIG. 2 provides sectional elevation view of the exemplary dishwashing appliance of FIG. 1 illustrating an exemplary embodiment of a silverware basket mounted to a lower rack assembly of the dishwashing appliance.
Figure 3:
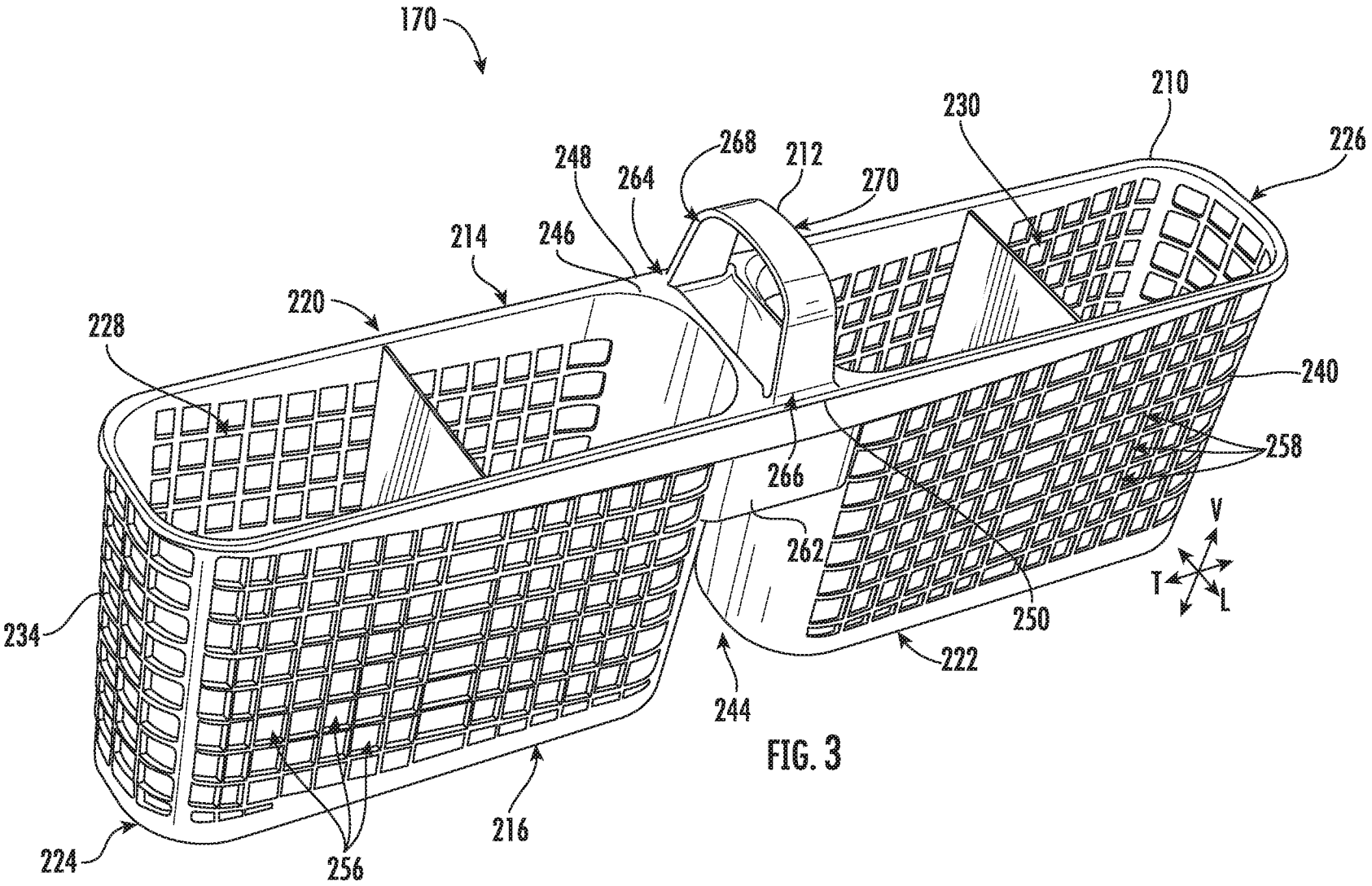
FIG. 3 provides a top perspective view of a silverware basket according to exemplary embodiments of the present disclosure.
Figure 4:
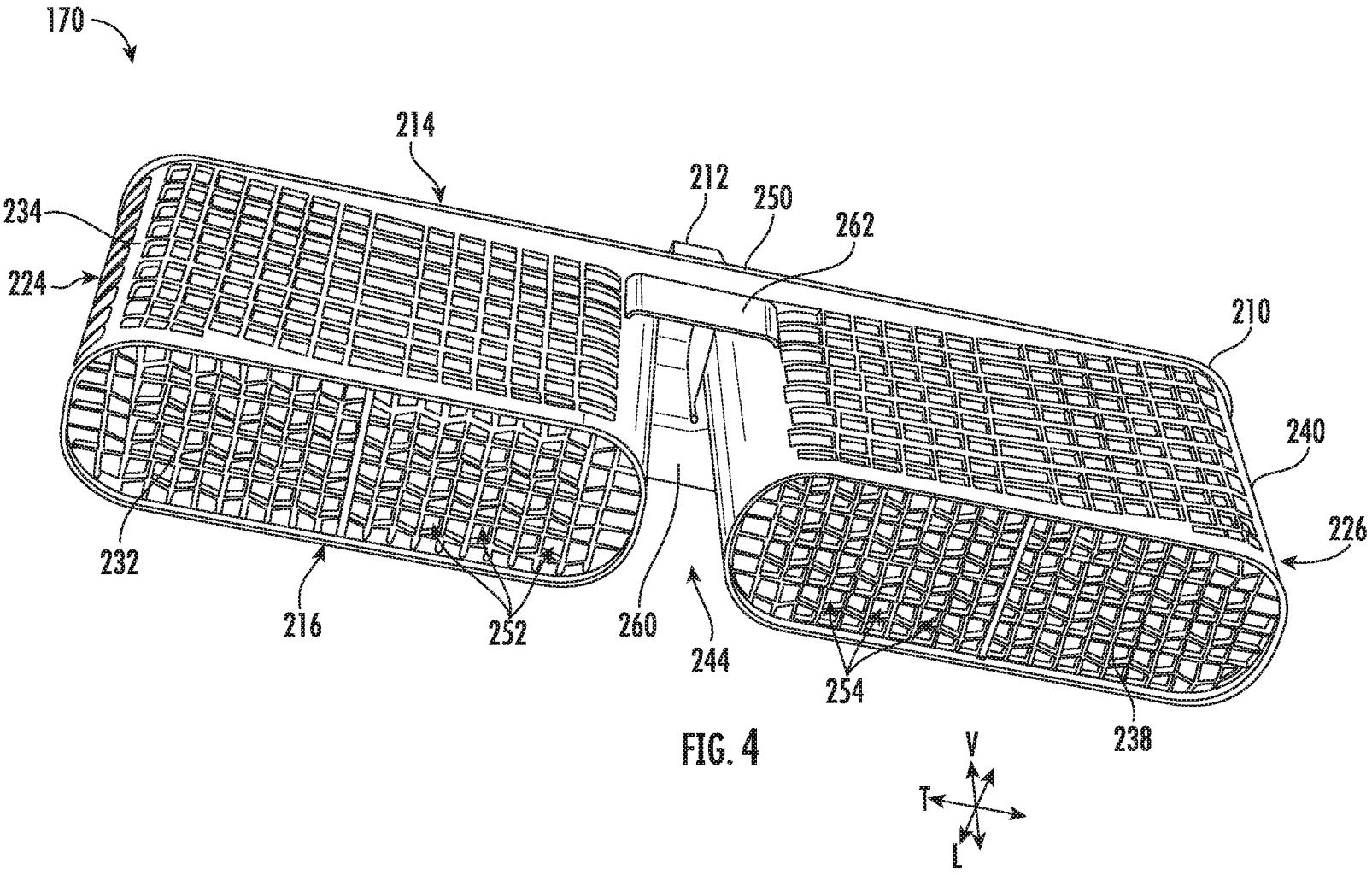
FIG. 4 provides a bottom perspective view of the exemplary silverware basket of FIG. 3.
Figure 5:
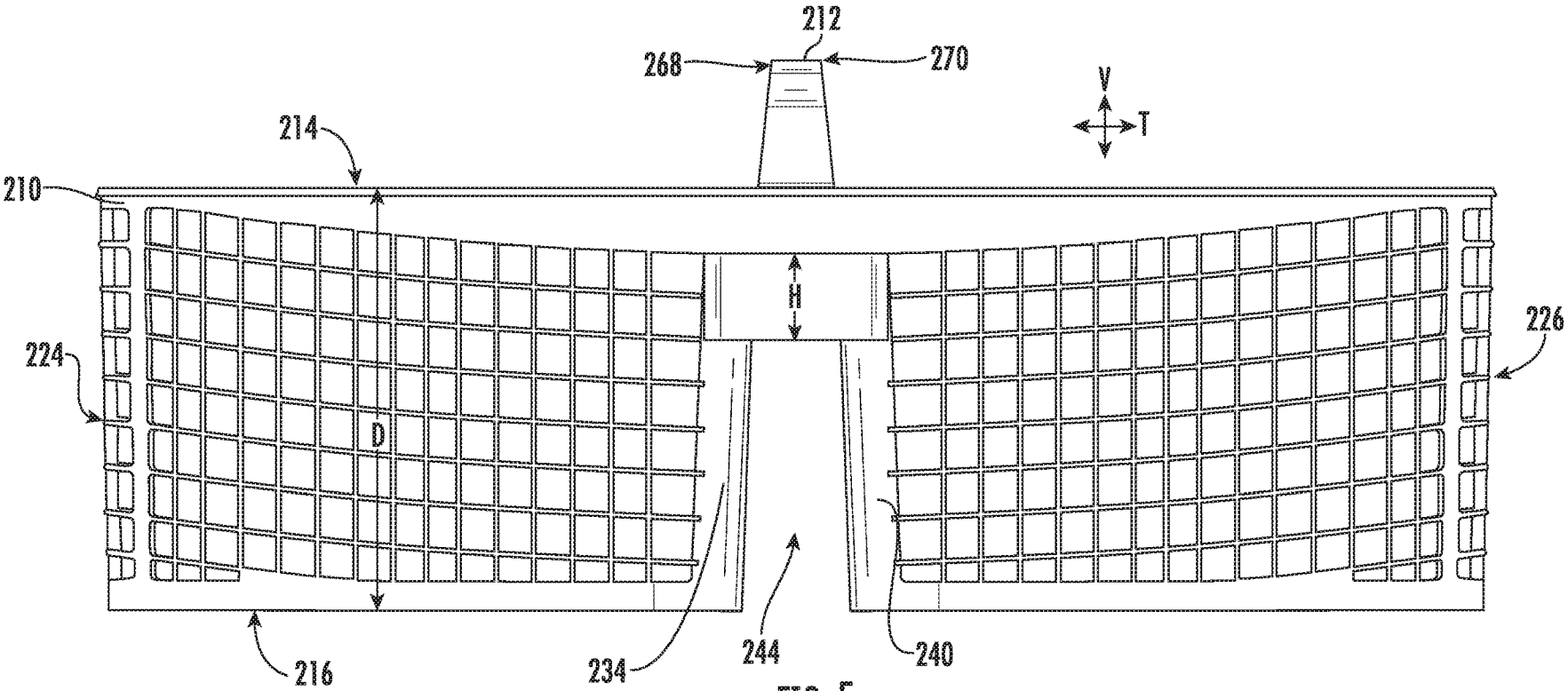
FIG. 5 provides a side elevation view of the exemplary basket of FIG. 3.

Turning now to the figures, FIGS. 1 and 2 illustrate exemplary embodiments of a domestic dishwasher or dishwashing appliance 100 that may be configured in accordance with aspects of the present disclosure. As shown in FIGS. 1 and 2, the dishwashing appliance 100 may include a cabinet 102 having a tub 104 therein defining a wash chamber 106. The tub 104 may generally include a front opening and a door 108 hinged at its bottom 110 for movement between a normally closed vertical position (shown in FIGS. 1 and 2), wherein the wash chamber 106 is sealed shut for washing operation, and a horizontal open position for loading and unloading of articles from the dishwasher. Optionally, a latch 112 may be used to lock and unlock the door 108 for access to the chamber 106.

Generally, the tub 104 may define a discrete vertical direction V, lateral direction L, and transverse direction T. Vertical direction V, lateral direction L, and transverse direction T are orthogonally oriented such that vertical direction V, lateral direction L, and transverse direction T form an orthogonal directional system.

As is understood, the tub 104 may generally have a rectangular cross-section defined by various wall panels or walls. For example, as shown in FIG. 2, the tub 104 may include a top wall 160 and a bottom wall 162 spaced apart from one another along a vertical direction V of the dishwashing appliance 100. Additionally, the tub 104 may include a plurality of sidewalls 164 (e.g., three sidewalls) extending between the top and bottom walls 160, 162. It should be appreciated that the tub 104 may generally be formed from any suitable material. For instance, in several embodiments, the tub 104 is formed from a ferritic material, such as stainless steel, or a polymeric material.

As particularly shown in FIG. 2, upper and lower guide rails 114, 116 may be mounted on opposing sidewalls 164 of the tub 104 and may be configured to accommodate roller-equipped rack assemblies 120 and 122. Each of the rack assemblies 120, 122 may be fabricated into lattice structures including a plurality of elongated members 124 (for clarity of illustration, not all elongated members making up assemblies 120 and 122 are shown in FIG. 2). Additionally, each rack 120, 122 may be adapted for movement between an extended loading position (not shown) in which the rack 120, 122 is substantially positioned outside the wash chamber 106, and a retracted position (shown in FIGS. 1 and 2) in which the rack 120, 122 is located inside the wash chamber 106. This may be facilitated by rollers 126 and 128, for example, mounted onto racks 120 and 122, respectively.

In some embodiments, a silverware basket 170 is removably mounted to lower rack assembly 122. In additional or alternative exemplary embodiments, the basket can be selectively or removably attached to other portions of dishwashing appliance 100 (e.g., upper rack assembly 120 or door 108). As will be described in detail below, the silverware basket 170 defines one or more storage chambers or volumes. Generally, silverware basket 170 is configured to receive silverware, flatware, utensils, and the like, which might be too small to be accommodated by the upper and lower rack assemblies 120, 122.

The dishwashing appliance 100 includes one or more spray assemblies housed within the wash chamber 106. For instance, the dishwashing appliance 100 may include a lower spray-arm assembly 130 that is rotatably mounted within a lower region 132 of the wash chamber 106 directly above the bottom wall 162 of the tub 104 so as to rotate in relatively close proximity to the rack assembly 122. As shown in FIG. 2, a mid-level spray-arm assembly 136 may be located in an upper region of the wash chamber 106, such as by being located in close proximity to the upper rack 120. Moreover, an upper spray assembly 138 may be located above the upper rack 120.

As is generally understood, the lower and mid-level spray-arm assemblies 130, 136 and the upper spray assembly 138 may generally form part of a fluid circulation assembly 140 for circulating fluid (e.g., water and dishwasher fluid) within the tub 104. As shown in FIG. 2, the fluid circulation assembly 140 may also include a pump 142 located in a machinery compartment 144 located below the bottom wall 162 of the tub 104. One or all of the spray assemblies 130, 136, 138 may be in fluid communication with the pump 142 (e.g., to receive a pressurized wash fluid therefrom). Additionally, each spray-arm assembly 130, 136 may include an arrangement of discharge ports or orifices for directing washing liquid onto dishes or other articles located in rack assemblies 120 and 122, which may provide a rotational force by virtue of wash fluid flowing through the discharge ports. The resultant rotation of the lower spray-arm assembly 130 provides coverage of dishes and other dishwasher contents with a spray (e.g., a spray of wash fluid).

It should be appreciated that, although the dishwashing appliance 100 will generally be described herein as including three spray assemblies 130, 136, 138, the dishwashing appliance may, in alternative embodiments, include any other number of spray assemblies, including two spray assemblies, four spray assemblies or five or more spray assemblies. For instance, in addition to the lower and mid-level spray-arm assemblies 130, 136 and the upper spray assembly 138 (or as an alternative thereto), the dishwashing appliance 100 may include one or more other spray assemblies or wash zones for distributing fluid within the wash chamber 106.

The dishwashing appliance 100 may be further equipped with a controller 146 configured to regulate operation of the dishwasher 100. The controller 146 may generally include one or more memory devices and one or more microprocessors, such as one or more general or special purpose microprocessors operable to execute programming instructions or micro-control code associated with a cleaning cycle. The memory may represent random access memory such as DRAM, or read only memory such as ROM or FLASH. In some embodiments, the processor executes programming instructions stored in memory. The memory may be a separate component from the processor or may be included onboard within the processor.

The controller 146 may be positioned in a variety of locations throughout dishwashing appliance 100. In the illustrated embodiment, the controller 146 is located within a control panel area 148 of the door 108, as shown in FIG. 1. In such an embodiment, input/output ("I/O") signals may be routed between the control system and various operational components of dishwashing appliance 100 along wiring harnesses that may be routed through the bottom 110 of the door 108. Typically, the controller 146 includes a user interface panel/controls 150 through which a user may select various operational features and modes and monitor progress of the dishwasher 100. In one embodiment, the user interface 150 may represent a general purpose I/O ("GPIO") device or functional block. Additionally, the user interface 150 may include input components, such as one or more of a variety of electrical, mechanical or electro-mechanical input devices including rotary dials, push buttons, and touch pads. The user interface 150 may also include a display component, such as a digital or analog display device designed to provide operational feedback to a user. The user interface 150 may be in communication with the controller 146 via one or more signal lines or shared communication busses.

Additionally, as shown in FIG. 2, a portion of the bottom wall 162 of the tub 104 may be configured as a tub sump portion 152 that is configured to accommodate one or more components of the fluid recirculation assembly 140 (e.g., a filter assembly (not shown) or other components). It should be appreciated that, in several embodiments, the bottom wall 162 of the tub 104 may be formed as a single, integral, unitary component such that the tub sump portion 152 as well as the surrounding portions of the bottom wall 162 are formed integrally with one another. Alternatively, the tub sump portion 152 may be configured as a separate component configured to be attached to the remaining portion(s) of the bottom wall 162.

Moreover, as shown in FIG. 2, the fluid recirculation assembly 140 may also include a diverter assembly 184 in fluid communication with the pump 142 for diverting fluid between one or more of the spray-arm assemblies 130, 136, 138. For example, the diverter assembly 184 may, in several embodiments, include an inlet 192 coupled to the pump 142 (e.g., via pump conduit 180 shown in FIG. 2) for directing fluid into the diverter assembly 184 and first and second outlets 186, 188 for directing the fluid received from the pump 142 to the lower spray-arm assembly 130 or the mid-level and upper spray-arm assemblies 136, 138, respectively. In some such embodiments, the first outlet 186 may be configured to be directly coupled to the lower spray-arm assembly 130 and the second outlet 188 may be coupled to a suitable fluid conduit 182 of the fluid recirculation assembly 140 for directing fluid to the mid-level and upper spray-arm assemblies 136, 138. Optionally, a third outlet 190 may be direct the fluid received from the pump 142 to a separate spray assembly. Additionally, the diverter assembly 184 may also include a diverting valve 194 to selectively divert the flow of fluid through the assembly 184 to the first outlet 186, the second outlet 188, or the third outlet 190.

It should be appreciated that the present subject matter is not limited to any particular style, model, or configuration of dishwashing appliance. The exemplary embodiments depicted in FIGS. 1 and 2 are simply provided for illustrative purposes only. For example, different locations may be provided for the user interface 150, different configurations may be provided for the racks 120, 122, and other differences may be applied as well.

Referring now to FIGS. 3 through 7, various views are provided of silverware basket 170, including a container body 210 and a handle 212, in isolation (i.e., apart from rack 122 or the rest of appliance 100—FIG. 2). It is understood that as described below, references to the vertical, lateral, and transverse directions V, L, T (e.g., defined by silverware basket 170) are made with respect to the silverware basket 170 being mounted within a rack assembly (e.g., as illustrated in FIG. 2).

As shown, the container body 210 of silverware basket 170 generally extends along the vertical direction V between a top container end 214 and a bottom container end 216, between the lateral direction L between a first lateral side 220 and a second lateral side 222, and along the transverse direction T between a first transverse end 224 and a second transverse end 226. As will be described in detail below, silverware basket 170 may be generally formed as a single, integral, unitary component, advantageously requiring no post-molding or post-formation processing (e.g., attachment of multiple parts, coating, or polishing). In particular, the handle 212 is formed as an integral unitary component with container body 210 and extends upward therefrom (e.g., at the top container end 214).

Generally, container body 210 defines two discrete container volumes that are spaced apart from each other along the transverse direction T. Specifically, a first base wall 232 and first sidewall 234 define a first container volume 228 proximal to first transverse end 224 (i.e., distal to second transverse end 226) while a second base wall 238 and a second sidewall 240 define a second container volume 230 proximal to second transverse end 226 (i.e., distal to first transverse end 224). First base wall 232 and second base wall 238 may be disposed at the bottom container end 216 to define a bottom of first and second container volumes 228, 230, respectively. In some embodiments, the first and second base walls 232, 238 are separated (e.g., along the transverse direction T) by an intermediate gap 244.

Extending vertically (e.g., upward) from the first and second base walls 232, 238, first sidewall 234 and second sidewall 240 may define the horizontal bounds of first and second container volumes 228, 230, respectively. In other words, first sidewall 234 extends vertically from first base wall 232 to further define first container volume 228 while second sidewall 240 extends from second base wall 238 to further define second container volume 230. In certain embodiments, first and second sidewalls 234, 240 extend to top container end 214. For instance, first sidewall 234 or second sidewall 240 may terminate at top container end 214. Moreover, first sidewall 234 and second sidewall 240 may each define a respective opening at top container end 214. Thus, access to first container volume 228 may be permitted through the opening defined by first sidewall 234, and access to second container volume 230 may be permitted through the opening defined by second sidewall 240.

In some embodiments, the openings of first and second sidewalls 234, 240 are spaced apart from each other (e.g., along the transverse direction T) while being connected by an intermediate segment 246 (e.g., above intermediate gap 244). The intermediate segment 246 may include one or more transverse rails.

In exemplary embodiments, a first transverse rail 248 forms a portion of the intermediate segment 246 extending (e.g., along the top container end 214) from the first sidewall 234 to the second sidewall 240. For instance, the first transverse rail 248 may extend on the first lateral side 220. In additional or alternative embodiments, a second transverse rail 250 forms a portion of the intermediate segment 246 extending (e.g., along the top container end 214) from the first sidewall 234 to the second sidewall 240. For instance, the second transverse rail 250 may extend on the second lateral side 222 (e.g., as a mirror-image member or parallel member with first transverse rail 250).

One or more portions of container body 210 may be defined as lattice or perforated members. Thus, multiple fluid slots or perforations may be defined therethrough (e.g., to permit water or wash fluid to flow to/from the container volumes 228, 230). In some embodiments, the first base wall 232 defines a first plurality of vertical perforations 252 in fluid communication with the first container volume 228. In additional or alterative embodiments, the second base wall 238 defines a second plurality of vertical perforations 254 in fluid communication with the second container volume 230. In further additional or alternative embodiments, the first sidewall 234 defines a first plurality of horizontal perforations 256 in fluid communication with the first container volume 228. In still further additional or alterative embodiments, the second base wall 238 defines a second plurality of horizontal perforations 258 in fluid communication with the second container volume 230.

In some embodiments, one or more braces are provided between the first sidewall 234 and second sidewall 240. For instance, a first brace 260 may extend between first sidewall 234 and second sidewall 240 (e.g., on first lateral side 220). Moreover, first brace 260 may be disposed below first transverse rail 248. Thus, first brace 260 may join the first sidewall 234 to the second sidewall 240 at a location below top container end 214 and, optionally, above bottom container end 216. Additionally or alternatively, a second brace 262 may extend between first sidewall 234 and second sidewall 240 (e.g., on second lateral side 222, apart from first brace 260). Moreover, second brace 262 may be disposed below second transverse rail 250. Thus, second brace 262 may join the first sidewall 234 to the second sidewall 240 at a location below top container end 214 and, optionally, above bottom container end 216. In some such embodiments, first brace 260 and second brace 262 may be disposed at opposite lateral sides of intermediate gap 244.

Generally, the first and second braces 260, 262 may span a vertical portion of container body 210 that is less than the entirety. Specifically, a vertical distance D (e.g., vertical maximum distance) is defined between top container end 214 and bottom container end 216 while the first and second braces 260, 262 each span a height H (e.g., along the vertical direction V) that is less than the vertical distance D. For instance, the height H of the braces 260, 262 may be greater than or equal to ten percent of the vertical distance D (e.g., while still being less than the same). Advantageously, the disclosed silverware basket 170 and braces 260, 262 may resist or prevent deformation that may otherwise occur (e.g., at the handle 212 or intermediate segment 246).

As noted above, handle 212 is formed as a single, integral, unitary component with container body 210 and extends upward therefrom (e.g., at the top container end 214). In some embodiments, handle 212 is shaped as an elevated loop formed from intermediate segment 246. In other words, handle 212 may form a shape similar to a lower-case "n" or inverted "U" (e.g., having a flat portion elevated between a pair of downward-sloped portions). Thus, handle 212 may define an apex above and between two terminating ends (e.g., lateral ends). Specifically, handle 212 may have a first lateral end 264 proximal to first lateral side 220 (i.e., distal to second lateral side 222) and a second lateral end 266 proximal to second lateral side 222 (i.e., distal to first lateral side 220). First lateral end 264 may joined to first transverse rail 248 (e.g., integrally therewith at top container end 214). Second lateral end 266 may be joined to second transverse rail 250 (e.g., integrally therewith at top container end 214).

Since handle 212 extends upward from or above container body 210, one or more edges of handle 212 may be separated from container body 210 (e.g., as free or uncovered edges). In exemplary embodiments, this includes a first transverse edge 268 and a second transverse edge 270 defined opposite of the first transverse edge 268 relative to the transverse direction T. When assembled, first transverse edge 268 is disposed proximal to first container volume 228 (i.e., distal to second container volume 230) while second transverse edge 270 is positioned proximal to second container volume 230 (i.e., distal to first container volume 228. First transverse edge 268 and second transverse edge 270 may be mirror images of each other (e.g., on opposite sides of a plane defined by the vertical direction V and lateral direction L).

Between first transverse edge 268 and second transverse edge 270, a solid substrate of handle 212 may be formed. Such a substrate may be defined according to a constant profile or cross-section. Thus, the first and second transverse edges 268, 270 may define or share a common thickness dimension with the solid substrate. As shown, the solid substrate may define a bottom surface 236 and a top surface 242 (i.e., extending between the first transverse edge 268 and the second transverse edge 270). In particular, the bottom and top surfaces 236, 242 may be spaced apart by transverse edges 268, 270 (e.g., vertically or laterally by the thickness dimensioned defined by transverse edges 268, 270). The bottom surface 236 may be directed generally downward toward the intermediate gap 244 between container volumes 228, 230 while top surface 242 is directed upward or outward, away from the intermediate gap 244. One or both of bottom and top surfaces 236, 242 may be advantageously smooth or otherwise free of any sharp or abrasive formation that may be felt by a user's hand.

Figure 6:
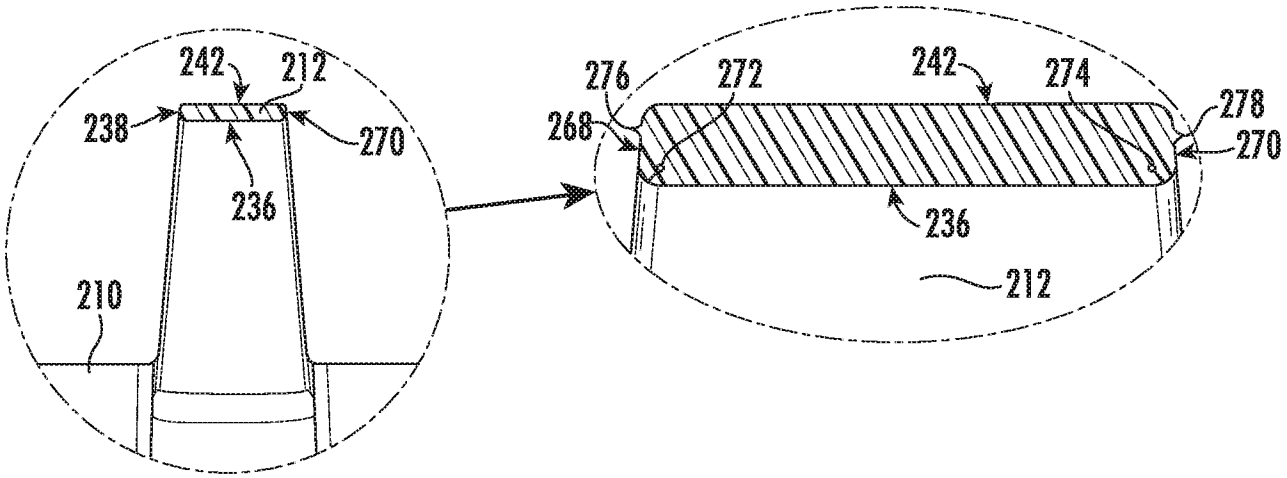
FIG. 6 provides a magnified, sectional, elevation view of the handle of the exemplary basket of FIG. 3.
Figure 7:
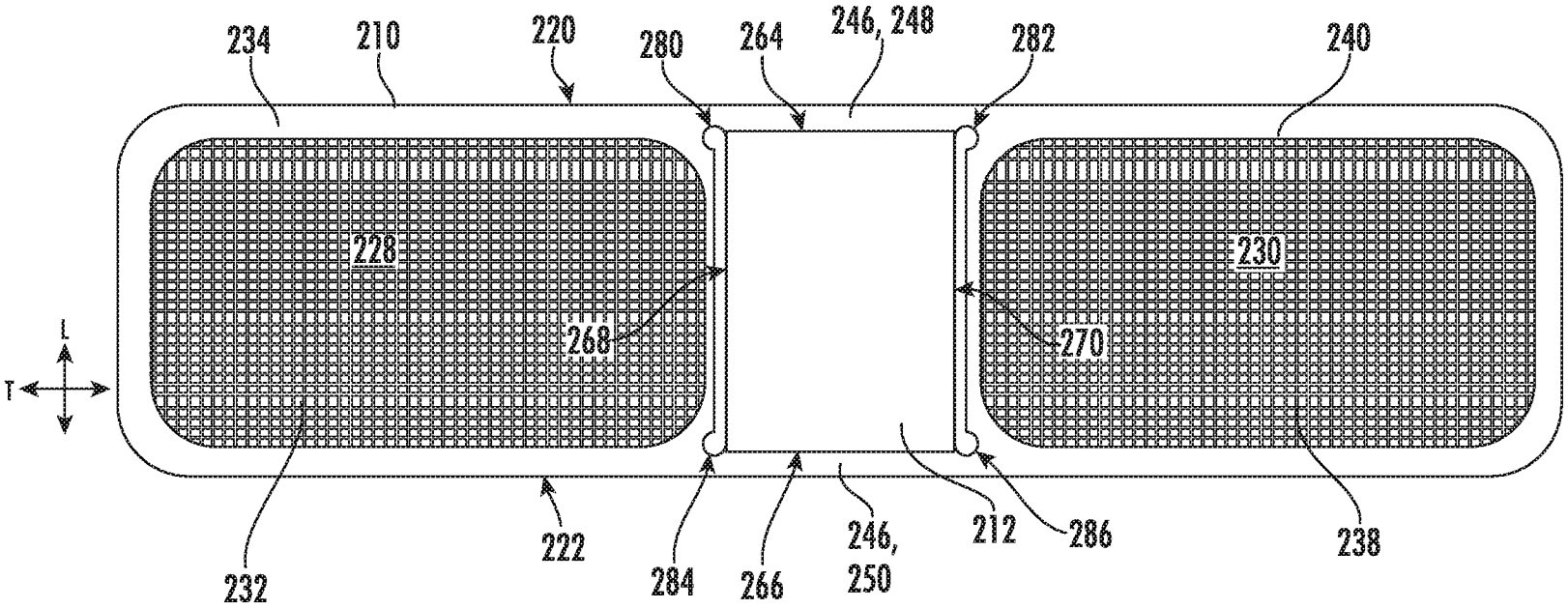
FIG. 7 provides a top plan view of the exemplary basket of FIG. 3.

Turning especially to FIG. 6, in certain embodiments, one or more transition radii (e.g., first transition radius 272 and second transition radius 274) are defined as curved surfaces (i.e., convex fillets or rounds) between bottom surface 236 and the transverse edges 268, 270. For instance, a non-orthogonal first transition radius 272 may be defined along the transversal transition from bottom surface 236 to first transverse edge 268. A non-orthogonal second transition radius 274 may be defined along the opposite transversal transition bottom surface 236 to second transverse edge 270.

In some embodiments, bottom surface 236 extends along a flat (e.g., horizontal plane) and defines an angle with first transverse edge 268, which extends along another flat plane. For instance, the angle between bottom surface 236 and first transverse edge 268 may be greater than or equal to 150 degrees. In other words, the unoccupied space between the two flat planes of bottom surface 236 and first transverse edge 268 may be defined according to an angle that is greater than or equal to 150 degrees. Nonetheless, first transition radius 272 may be defined according to one or more predetermined radii of curvature such that a sharp corner is not defined along first transverse edge 268. For instance, first transition radius 272 may have a radius of curvature between 0.01 inches and 0.5 inches (e.g., between 0.02 inches and 0.25 inches) at an apex of first transition radius 272.

In additional or alternative embodiments, bottom surface 236 extends along a flat (e.g., horizontal plane) and defines an angle with second transverse edge 270 which extends along another flat plane. For instance, the angle between bottom surface 236 and second transverse edge 270 may be greater than or equal to 150 degrees. In other words, the unoccupied space between the two flat planes of bottom surface 236 and second transverse edge 270 may be defined according to an angle that is greater than or equal to 150 degrees. Nonetheless, second transition radius 274 may be defined according to one or more predetermined radii of curvature such that a sharp corner is not defined along second transverse edge 270. For instance, second transition radius 274 may have a radius of curvature between 0.01 inches and 0.5 inches (e.g., between 0.02 inches and 0.25 inches) at an apex of second transition radius 274.

Returning generally to FIGS. 3 through 7, in some embodiments, silverware basket 170 is predominately generated from a single injection-mold process. For instance, container body 210, including container volumes 228, 230, may be formed in an injection mold from a polymer material, as would be understood. Although the first and second sidewalls 234, 240 may connected by the intermediate segment 246, the segment of material that ultimately forms the handle 212 may be a flat, continuous segment within the intermediate segment 246 while the container body 210 is in the injection mold. Immediately after the injection mold process, a press may be forced upward from between the two container volumes 228, 230 (e.g., through the intermediate gap 244) and against a downward-facing portion of the intermediate segment 246. As the press is forced against the intermediate segment 246, a portion of material is lifted upward to form the handle 212. Specifically, the press pushes against the bottom surface 236 of handle 212 and through a surrounding portion of the intermediate segment 246 between the transverse rails 248, 250. The press may have a pair of raised rims at opposite transverse ends that generally cup or bound the bottom surface 236. Thus, the raised rims may define the first transition radius 272 and the second transition radius 274, which are bounded or supported against press while the handle 212 is being formed.

Since the handle 212 is formed from a previously-continuous segment of material, parting lines 276, 278 may be formed above the raised rims as the handle 212 is being pushed upward. Specifically, a first parting line 276 is defined along first transverse edge 268 (e.g., above bottom surface 236 or first transition radius 272). Thus, first parting line 276 may extend apart from bottom surface 236 (e.g., from first lateral end 264 to second lateral end 266). First transition radius 272 may be positioned between first parting line 276 and bottom surface 236. Additionally or alternatively, a second parting line 278 is defined along second transverse edge 270 (e.g., above bottom surface 236 or second transition radius 274). Thus, second parting line 278 may extend apart from bottom surface 236 (e.g., from first lateral end 264 to second lateral end 266). Second transition radius 274 may be positioned between second parting line 278 and bottom surface 236.

Advantageously, the parting lines 276, 278 may be defined away from bottom surface 236 (e.g., on respective transverse edges 268, 270). In turn, a user holding handle 212 naturally (e.g., such the user's fingers are positioned along bottom surface 236) would not have the weight of basket 170 transferred through any parting line or abrasive surface.

In optional embodiments, one or more enlarged notches are defined for one or more corresponding joints between handle 212 and container body 210. Each of the enlarged notches may be defined as a circular cutout or fillet that extends into the corresponding joint (e.g., such that the enlarged notch forms a semi-circular profile when viewed along the vertical direction V, such as above or below container volumes 228, 230). In other words, a center point of each notch may be disposed closer to an adjacent container volume or transverse rail than the actual point at which handle 212 meets container body 210. As shown, a first enlarged notch 280 may be defined at a joint of the first sidewall 234, the first transverse rail 248, and the handle 212. The center point of first enlarged notch 280 may be disposed proximal to first sidewall 234 and thus distal to first lateral end 264 of handle 212. A second enlarged notch 282 may be defined at a joint of the second sidewall 240, the first transverse rail 248, and the handle 212. The center point of second enlarged notch 282 may be disposed proximal to second sidewall 240 and thus distal to first lateral end 264 of handle 212. A third enlarged notch 284 may be defined at a joint of the first sidewall 234, the second transverse rail 250, and the handle 212. The center point of the third enlarged notch 284 may be disposed proximal to first sidewall 234 and thus distal to second lateral end 266 of handle 212. A fourth enlarged notch 286 may be defined at a joint of the second sidewall 240, the second transverse rail 250, and the handle 212. The center point of fourth enlarged notch 286 may be disposed proximal to second sidewall 240 and thus distal to second lateral end 266 of handle 212.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwashing appliance defining a vertical direction, the dishwashing appliance comprising:

a tub defining a wash chamber;

a pump configured to deliver a wash fluid into the wash chamber;

a spray assembly housed within the wash chamber of the tub in fluid communication with the pump to receive wash fluid therefrom;

a rack assembly slidably disposed within the wash chamber; and a unitary basket selectively received within the rack assembly, the unitary basket comprising a first base wall disposed at a bottom container end, a first sidewall extending vertically from the first base wall to a top container end, the first sidewall defining a first container volume with the first base wall, a second base wall disposed at the bottom container end, the second base wall being transversely spaced apart from the first base wall, a second sidewall extending vertically from the second base wall to the top container end, the second sidewall defining a second container volume with the second base wall, a first transverse rail extending from the first sidewall to the second sidewall on a first lateral side of the unitary basket, a second transverse rail extending from the first sidewall to the second sidewall on a second lateral side of the unitary basket, and a handle extending from the first transverse rail to the second transverse rail between the first container volume and the second container volume, the handle having a first transverse edge proximal to the first container volume and a second transverse edge proximal to the second container volume, wherein the handle defines a bottom surface and a top surface, wherein the bottom surface extends from the first transverse edge to the second transverse edge, wherein the top surface extends from the first transverse edge to the second transverse edge opposite the bottom surface, wherein the handle further defines a non-orthogonal first transition radius extending between the bottom surface and the first transverse edge, and wherein the handle further defines a non-orthogonal second transition radius extending between the bottom surface and the second transverse edge.

2. The dishwashing appliance of claim 1, wherein the first base wall defines a first plurality of perforations in fluid communication with the first container volume, and wherein the second base wall defines a second plurality of perforations in fluid communication with the second container volume.

3. The dishwashing appliance of claim 1, wherein a first parting line is defined along the first transverse edge, and wherein a second parting line is defined along the second transverse edge.

4. The dishwashing appliance of claim 3, wherein the first base wall defines a first plurality of perforations in fluid communication with the first container volume, and wherein the second base wall defines a second plurality of perforations in fluid communication with the second container volume.

5. The dishwashing appliance of claim 4, wherein the handle defines a bottom surface and a top surface, wherein the bottom surface extends from the first transverse edge to the second transverse edge, wherein the top surface extends from the first transverse edge to the second transverse edge opposite the bottom surface, wherein the handle further defines a non-orthogonal first transition radius extending between the bottom surface and the first parting line, and wherein the handle further defines a non-orthogonal second transition radius extending between the bottom surface and the second parting line.

6. The dishwashing appliance of claim 4, wherein the unitary silverware basket defines a plurality of enlarged notches comprising a first enlarged notch defined at a joint of the first sidewall, the first transverse rail, and the handle, a second enlarged notch defined at a joint of the second sidewall, the first transverse rail, and the handle, a third enlarged notch defined at a joint of the first sidewall, the second transverse rail, and the handle, and a fourth enlarged notch defined at a joint of the second sidewall, the second transverse rail, and the handle.

7. The dishwashing appliance of claim 4, wherein the unitary silverware basket further comprises:

a first brace disposed below the first transverse rail and extending between the first sidewall and the second sidewall, and a second brace disposed below the second transverse rail and extending between the first sidewall and the second sidewall.

8. The dishwashing appliance of claim 7, wherein the first base wall and the second wall are disposed at a bottom container end, wherein a vertical distance is defined between the top container end and the bottom container end, and wherein the first brace and the second brace each span a height greater than or equal to twenty percent of the vertical distance.

9. The dishwashing appliance of claim 3, wherein the first base wall defines a first plurality of perforations in fluid communication with the first container volume, and wherein the second base wall defines a second plurality of perforations in fluid communication with the second container volume.

10. The dishwashing appliance of claim 9, wherein the unitary silverware basket defines a plurality of enlarged notches comprising a first enlarged notch defined at a joint of the first sidewall, the first transverse rail, and the handle, a second enlarged notch defined at a joint of the second sidewall, the first transverse rail, and the handle, a third enlarged notch defined at a joint of the first sidewall, the second transverse rail, and the handle, and a fourth enlarged notch defined at a joint of the second sidewall, the second transverse rail, and the handle.

11. The dishwashing appliance of claim 9, further comprising:

a first brace disposed below the first transverse rail and extending between the first sidewall and the second sidewall; and a second brace disposed below the second transverse rail and extending between the first sidewall and the second sidewall.

12. The dishwashing appliance of claim 11, wherein the first base wall and the second wall are disposed at a bottom container end, wherein a vertical distance is defined between the top container end and the bottom container end, and wherein the first brace and the second brace each span a height greater than or equal to ten percent of the vertical distance.

13. The dishwashing appliance of claim 1, wherein the unitary silverware basket defines a plurality of enlarged notches comprising a first enlarged notch defined at a joint of the first sidewall, the first transverse rail, and the handle, a second enlarged notch defined at a joint of the second sidewall, the first transverse rail, and the handle, a third enlarged notch defined at a joint of the first sidewall, the second transverse rail, and the handle, and a fourth enlarged notch defined at a joint of the second sidewall, the second transverse rail, and the handle.

14. The dishwashing appliance of claim 1, further comprising:

a first brace disposed below the first transverse rail and extending between the first sidewall and the second sidewall; and a second brace disposed below the second transverse rail and extending between the first sidewall and the second sidewall.

15. The dishwashing appliance of claim 14, wherein the first base wall and the second wall are disposed at a bottom container end, wherein a vertical distance is defined between the top container end and the bottom container end, and wherein the first brace and the second brace each span a height greater than or equal to ten percent of the vertical distance.

16. A dishwashing appliance defining a vertical direction, the dishwashing appliance comprising:

a tub defining a wash chamber;

a pump configured to deliver a wash fluid into the wash chamber;

a spray assembly housed within the wash chamber of the tub in fluid communication with the pump to receive wash fluid therefrom;

a rack assembly slidably disposed within the wash chamber; and a unitary basket selectively received within the rack assembly, the unitary basket comprising a first base wall disposed at a bottom container end, a first sidewall extending vertically from the first base wall to a top container end, the first sidewall defining a first container volume with the first base wall, a second base wall disposed at the bottom container end, the second base wall being transversely spaced apart from the first base wall, a second sidewall extending vertically from the second base wall to the top container end, the second sidewall defining a second container volume with the second base wall, a first transverse rail extending from the first sidewall to the second sidewall on a first lateral side of the unitary basket, a second transverse rail extending from the first sidewall to the second sidewall on a second lateral side of the unitary basket, and a handle extending from the first transverse rail to the second transverse rail between the first container volume and the second container volume, the handle having a first transverse edge proximal to the first container volume and a second transverse edge proximal to the second container volume, wherein a first parting line is defined along the first transverse edge, wherein the first base wall defines a first plurality of perforations in fluid communication with the first container volume, wherein the handle defines a bottom surface and a top surface, wherein the bottom surface extends from the first transverse edge to the second transverse edge, wherein the top surface extends from the first transverse edge to the second transverse edge opposite the bottom surface, and wherein the handle further defines a non-orthogonal first transition radius extending between the bottom surface and the first parting line.

17. The dishwashing appliance of claim 16, wherein the unitary silverware basket defines a plurality of enlarged notches comprising a first enlarged notch defined at a joint of the first sidewall, the first transverse rail, and the handle, a second enlarged notch defined at a joint of the second sidewall, the first transverse rail, and the handle, a third enlarged notch defined at a joint of the first sidewall, the second transverse rail, and the handle, and a fourth enlarged notch defined at a joint of the second sidewall, the second transverse rail, and the handle.

18. The dishwashing appliance of claim 16, further comprising:

a first brace disposed below the first transverse rail and extending between the first sidewall and the second sidewall; and a second brace disposed below the second transverse rail and extending between the first sidewall and the second sidewall.

19. The dishwashing appliance of claim 18, wherein the first base wall and the second wall are disposed at a bottom container end, wherein a vertical distance is defined between the top container end and the bottom container end, and wherein the first brace and the second brace each span a height greater than or equal to ten percent of the vertical distance.

20. A dishwashing appliance defining a vertical direction, the dishwashing appliance comprising:

a tub defining a wash chamber;

a pump configured to deliver a wash fluid into the wash chamber;

a spray assembly housed within the wash chamber of the tub in fluid communication with the pump to receive wash fluid therefrom;

a rack assembly slidably disposed within the wash chamber; and a unitary basket selectively received within the rack assembly, the unitary basket comprising a first base wall disposed at a bottom container end, a first sidewall extending vertically from the first base wall to a top container end, the first sidewall defining a first container volume with the first base wall, a second base wall disposed at the bottom container end, the second base wall being transversely spaced apart from the first base wall, a second sidewall extending vertically from the second base wall to the top container end, the second sidewall defining a second container volume with the second base wall, a first transverse rail extending from the first sidewall to the second sidewall on a first lateral side of the unitary basket, a second transverse rail extending from the first sidewall to the second sidewall on a second lateral side of the unitary basket, and a handle extending from the first transverse rail to the second transverse rail between the first container volume and the second container volume, the handle having a first transverse edge proximal to the first container volume and a second transverse edge proximal to the second container volume, wherein the handle defines a bottom surface and a top surface, wherein the bottom surface extends from the first transverse edge to the second transverse edge, wherein the top surface extends from the first transverse edge to the second transverse edge opposite the bottom surface, wherein the handle further defines a non-orthogonal first transition radius extending between the bottom surface and the first transverse edge, wherein the handle further defines a non-orthogonal second transition radius extending between the bottom surface and the second transverse edge, wherein the first base wall defines a first plurality of perforations in fluid communication with the first container volume, wherein the second base wall defines a second plurality of perforations in fluid communication with the second container volume, and wherein the unitary silverware basket defines a plurality of enlarged notches comprising a first enlarged notch defined at a joint of the first sidewall, the first transverse rail, and the handle, and a second enlarged notch defined at a joint of the second sidewall, the second transverse rail, and the handle.

* * * * *